US006209982B1

(12) United States Patent
Nakamura

(10) Patent No.: US 6,209,982 B1
(45) Date of Patent: Apr. 3, 2001

(54) INK JET RECORDING DEVICE CAPABLE OF RELIABLY DISCHARGING AIR BUBBLE DURING PURGING OPERATIONS

(75) Inventor: Hirotake Nakamura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/328,419

(22) Filed: Jun. 9, 1999

(30) Foreign Application Priority Data

Jun. 10, 1998 (JP) ..... 10-162386

(51) Int. Cl.[7] ..... B41J 2/165
(52) U.S. Cl. ..... 347/30; 347/87; 347/92
(58) Field of Search ..... 347/30, 20, 35, 347/92, 65, 68, 86, 87

(56) References Cited

U.S. PATENT DOCUMENTS 5,946,015 * 8/1999 Courtney ..... 347/92
6,003,986 * 12/1999 Keefe ..... 347/92

* cited by examiner

*Primary Examiner*—N. Le
*Assistant Examiner*—Shih-wen Hsieh
(74) *Attorney, Agent, or Firm*—Oliff & Berridge, PLC

(57) ABSTRACT

A manifold 40 is formed with an ink supply path 43, which fluidly connects an ink cartridge 50 and ejection channels 33 of an ink jet head 31. The ink supply path 43 has a broad portion 45 that broadens from a connection path 44 outward in a tapering manner. A space A defined between a mesh filter 40*a* and a mesh filter 53*a* is set to have a volume greater than a volume of a spherical shape B, which is inscribed by the ceiling surface of the broad portion 45 and an upper surface 31*a* of the ink jet head 31. Air is introduced into the space A during exchange of the ink cartridge 50. When the air is drawn into the broad portion 45 during purging operations, the air is supported in contact with the ink jet head 31 and also blocks the connection path 44.

8 Claims, 6 Drawing Sheets

INK JET RECORDING DEVICE CAPABLE OF RELIABLY DISCHARGING AIR BUBBLE DURING PURGING OPERATIONS

BACKGROUND OF THE INVENTION

1. Field of the Invention

The present invention relates to an ink jet recording device having a manifold fluidly connecting an ink cartridge with an ink jet head, and more specifically to the ink jet recording device capable of reliably discharging air bubbles from the manifold by purging operations.

2. Description of the Related Art

A conventional ink jet recording device includes an ink jet head having actuators. The actuators are formed from an electromechanical converting element or electrothermal converting element, and define a plurality of ink chambers aligned in a row. An ink cartridge storing ink is detachably attached to the ink jet head by a manifold. The manifold is formed with an ink supply path that normally broadens from the ink cartridge side to the ink jet head side so as to encompass the entire row of ink chambers. Ink in the ink cartridge is supplied through the ink supply path of the manifold into the ink chambers. When the actuators are energized, ink is ejected from the ink chambers through nozzles to form an image on a recording medium.

Normally, purging operations are performed when the ink cartridge is exchanged for a new one. Specifically, during the purging operations, suction force is applied to the nozzles of the ink jet head so as to introduce fresh ink from the new ink cartridge into the ink chambers. At the same time, air that was introduced into the manifold during exchange of the ink cartridge is discharged out of the ink jet head along with some ink.

However, when the air forms a single spherical air bubble that floats freely in the broad portion of ink supply path, ink flows around the air bubble during the purging operations. As a result, a sufficient pressure for discharging the air bubble may not be generated within the manifold. As a result, the air bubble remains in the ink supply path without being ejected during the purging operations. Also, because the air bubble itself has a relatively large volume, by coupling with micro-air bubbles dissolved in the ink, the air bubble can quickly grow to a sufficient extend to clog up the inlets to the ink chambers. As a result, shortly after the ink cartridge is exchanged, printing can become defective due to improper ejection of ink from the ink chamber.

Also, air introduced into the ink supply path during exchange of the ink cartridge may remain in the ink supply path without being discharged, because of changes in ink viscosity by temperature, variation in suction force generated by the purging operation, or other indefinite reasons.

SUMMARY OF THE INVENTION

It is an objective of the present invention to solve the above-described problems and also to provide an ink jet recording device having a manifold capable of efficiently ejecting air bubbles, which are introduced during exchange of ink cartridge, by using purging operations performed directly after exchange of ink cartridge.

In order to achieve, the above and other objectives, there is provided an ink jet recording device including an ink jet head, a manifold, and a cartridge. The ink jet head has a first surface and a second surface opposite from the first surface. The ink jet head is formed with a plurality of ink channels each extending from the first surface to the second surface, and each having an inlet port opened at the first surface and a nozzle opened at the second surface. The manifold is mounted on the first surface of the ink jet head, and is formed with an ink inlet path and an ink supply path fluidly connecting the ink inlet path with the plurality of the ink channels. The cartridge is replaceable and detachably mounted on the manifold. The cartridge is formed with an outlet port for supplying ink to the plurality of ink channels through the outlet port, the ink inlet path, the ink supply path, and the inlet port. When the cartridge is replaced, and air is introduced as a single air bubble into the ink supply path from the ink inlet path, the single air bubble is supported within the ink supply path while contacting the first surface of the ink jet head.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

An ink jet recording device 1 according to a preferred embodiment of the present invention will be described while referring to the accompanying drawings. In the following description, the expressions "upper", "lower", and "horizontal" are used throughout the description to define the various parts when the ink jet recording device is disposed in an orientation in which it is intended to be used.

Figure 1:
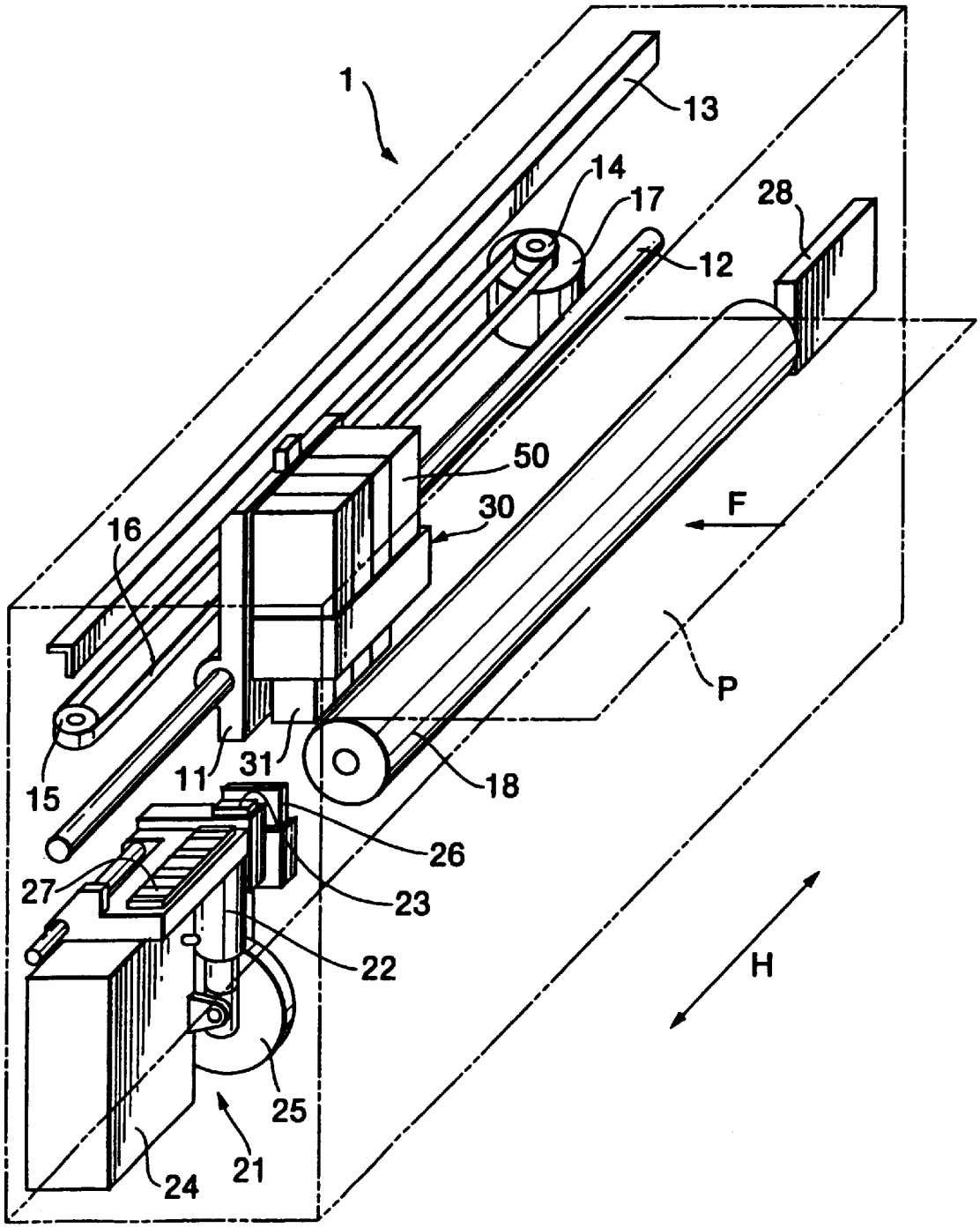
FIG. 1 is a perspective view showing an ink jet recording device according to an embodiment of the present invention.
Figure 2:
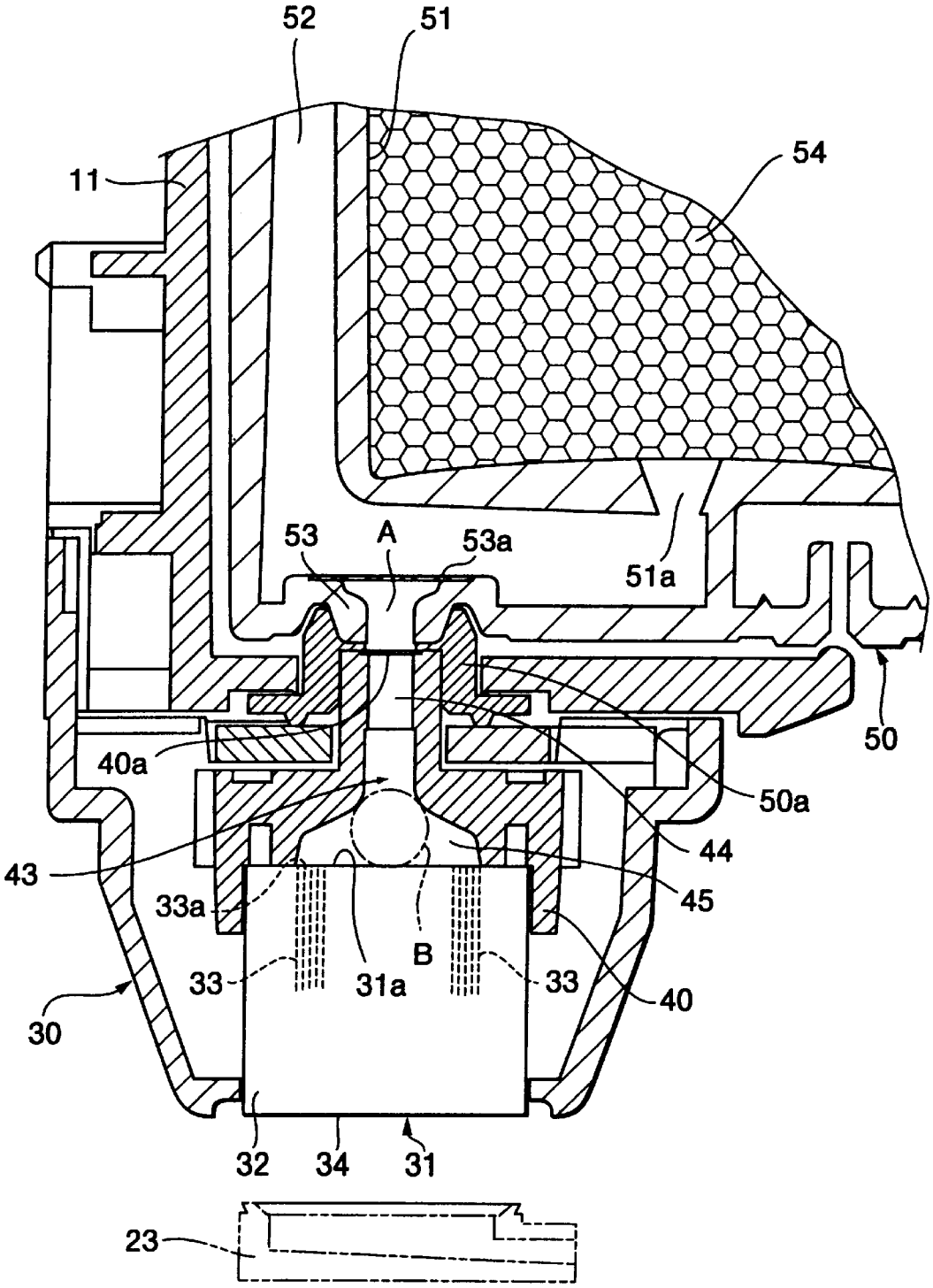
FIG. 2 is a partial cross-sectional view of the ink jet recording device of FIG. 1.

As shown in FIG. 1, the ink jet recording device 1 includes a carriage 11, a carriage shaft 12, a guide plate 13, a pair of pulleys 14, 15, a belt 16, a motor 17, a platen roller 18, a head unit 30, and four ink cartridges 50. Each of the ink cartridges 50 stores one of four different colored inks, that is cyan ink, magenta ink, yellow ink, and black ink. The head unit 30 includes four ink jet heads 31 and four manifolds 40 (FIG. 2). The manifolds 40 fluidly connect the ink cartridges 50 with corresponding ink jet heads 31 so that ink is supplied from the ink cartridge 50 to the corresponding ink jet heads 31. The head unit 30 and the ink cartridges 50 are both mounted on the carriage 11.

The carriage shaft 12 and the guide plate 13 are both supported by a frame (not shown) and extend in horizontal directions indicated by an arrow H. The carriage 11 is freely slidably supported on the carriage shaft 12 and the guide plate 13. The belt 16 is wound around and spans between the pair of pulleys 14, 15, and is connected to the carriage 11. When the motor 17 drives the pulley 14, the belt 16 reciprocally moves the carriage 11 along with the head unit 30 and ink cartridge 50 in the horizontal direction H.

The platen roller 18 is freely rotatable and extends in the horizontal direction H below the head unit 30 so as to be in facing confrontation with the lower surfaces of the ink jet heads 31. A print sheet P is fed by a feed mechanism (not shown) in a direction indicated by an arrow F. When the print sheet P is provided between the ink jet heads 31 and the platen roller 18, the ink jet heads 31 selectively eject ink onto the print sheet P to form an image on the print sheet P. The print sheet P formed with the image is, then, discharged out of the ink jet recording device 1.

Figure 3:
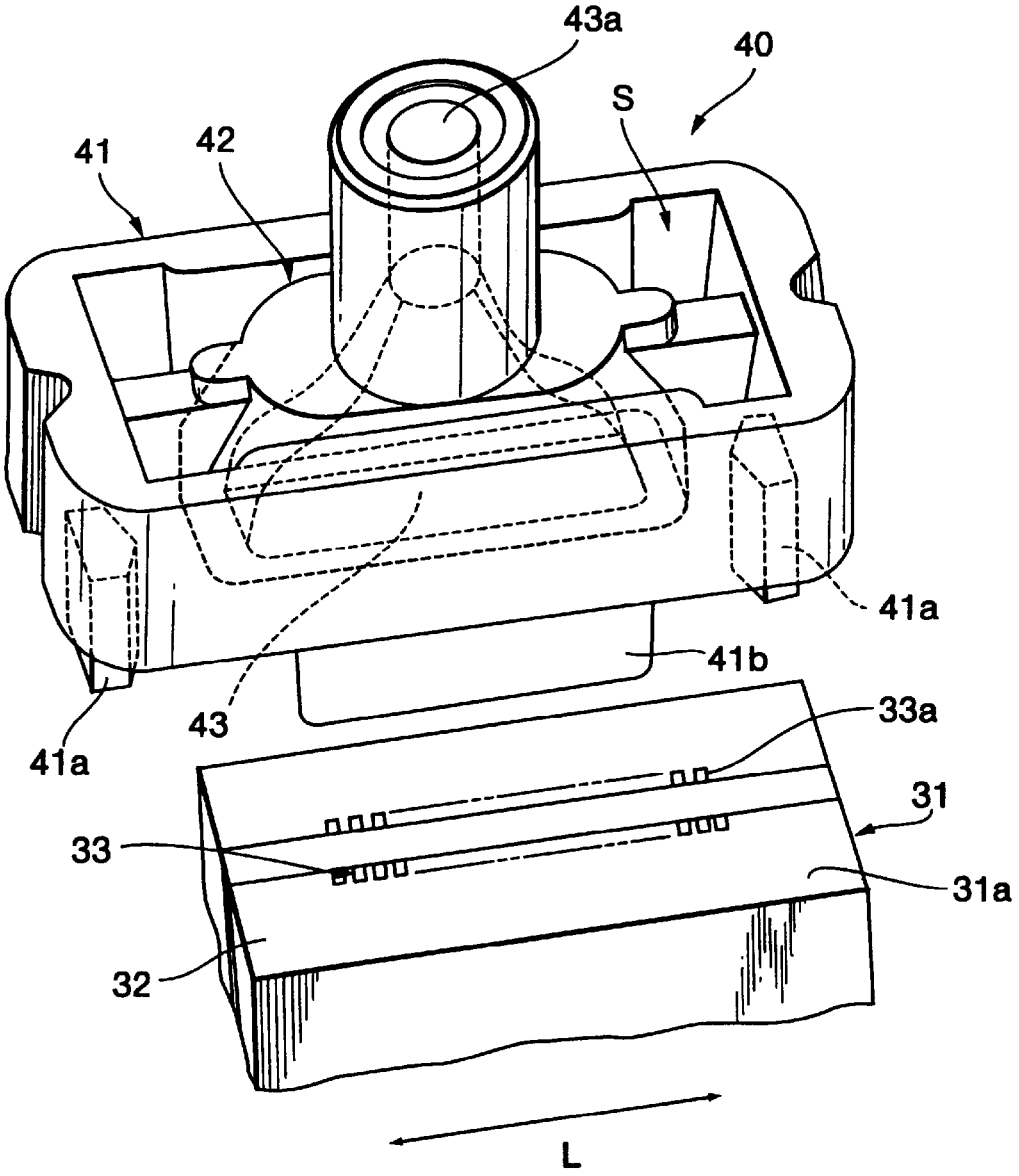
FIG. 3 is an exploded view showing a manifold and an ink jet head of the ink jet recording device.
Figure 4:
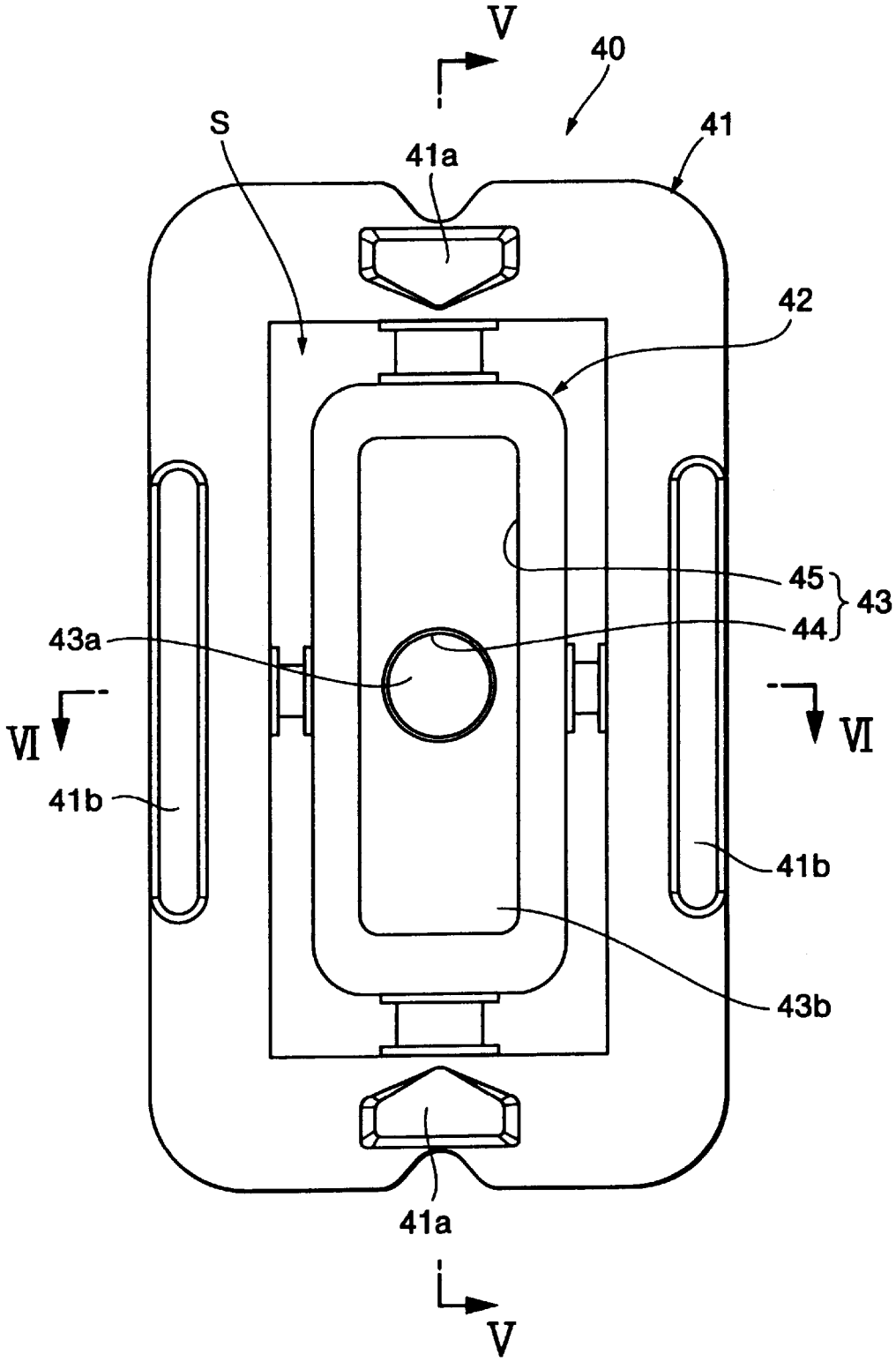
FIG. 4 is a plan view showing the manifold.

Next, detailed description of the ink jet heads 31 will be described. As shown in FIGS. 2 and 3, each ink jet head 31 includes an actuator 32 formed from a piezoelectric ceramic material and a nozzle plate 34 attached to the lower end of the actuator 32. The actuator 32 is formed with two rows of a plurality of ejection channels 33. The rows of ejection channels 33 extend longitudinally along the ink jet head 31 in directions indicated by an arrow L, and each ejection channel 33 extends from the lower end to the upper end of the actuator 32. The nozzle plate 34 is formed with a plurality of nozzles (not shown) in correspondence with the ejection channels 33.

Each ejection channel 33 has an ink inlet port 33*a* opened at an upper surface 31*a* of the ink jet head 31. Ink from the ink cartridge 50 is supplied into the ejection channels 33 through the ink inlet ports 33*a*.

When the actuator 32 is energized to deform during printing operations, the volume of the ejection channel 33 decreases, so that the ink is ejected from the ejection channel 33 through the nozzle, thereby forming an image on the print sheet P. Then, when the actuator 32 returns to its initial condition, the volume of the ejection channel 33 increases to its initial volume, thereby introducing ink from the ink cartridge 50 into the ejection channel 33. It should be noted that the ink jet head 31 can be designed such that ink is introduced into the ejection channel 33 when the actuator 32 deforms, and ink is ejected when the ejection channels 33 returns in its normal condition.

Next, the ink cartridge 50 will be described. As shown in FIG. 2, the ink cartridge 50 includes a joint member 50*a* by which the ink cartridge 50 is freely detachably attached to the upper end of the manifold 40. The ink cartridge 50 is formed with a first ink chamber 51, a second ink chamber 52, a connection hole 51*a,* and ink supply port 53. The first ink chamber 51 houses a porous ink absorption member 54 formed form polyurethane foam, for example. The ink absorption member 54 is impregnated with ink. The connection hole 51*a* fluidly connects the first ink chamber 51 with the second ink chamber 52. Ink impregnating the ink absorption member 54 in the first ink chamber 51 is supplied through the connection hole 51*a,* the second ink chamber 52, and the ink supply port 53 into the manifold 40. A mesh filter 53*a* is provided at the ink supply port 53.

Next, detailed description of the manifold 40 will be described. As shown in FIGS. 2 to 5, the manifold 40 includes a frame 41 and a main portion 42. The frame 41 has a pair of fixing ribs 41*a* and a pair of positioning ribs 41*b*. The pair of fixing ribs 41*a* are fixed to side surfaces of the ink jet head 31 by adhesive. The pair of positioning ribs 41*b* are for positioning the manifold 40 when fixed to the ink jet head 31. The main portion 40 is disposed interior of the frame 41 and partially connected to inner surfaces of the frame 41. A space S is defined between the frame 41 and the main portion 42. When the fixing rib 41*a* is fixed to the side surfaces of the ink jet head 31, adhesive is introduced to fill the space S, so that ink is prevented from leaking from the upper surface 31*a* of the ink jet head 31.

The lower end of the manifold 40 is fixed to the upper surface 31*a* of the ink jet head 31 so as to cover the upper surface 31*a*. The main portion 42 is formed with an ink supply path 43 fluidly connecting the ejection channels 33 with the ink cartridge 50. The ink supply path 43 includes a connection path 44 having a small diameter and a broad portion 45 connecting the connection path 44. The connection path 44 has an ink inlet 43*a* that is connected to the ink cartridge 50. A mesh filter 40*a* is provided at the ink inlet 43*a*.

Figure 5:
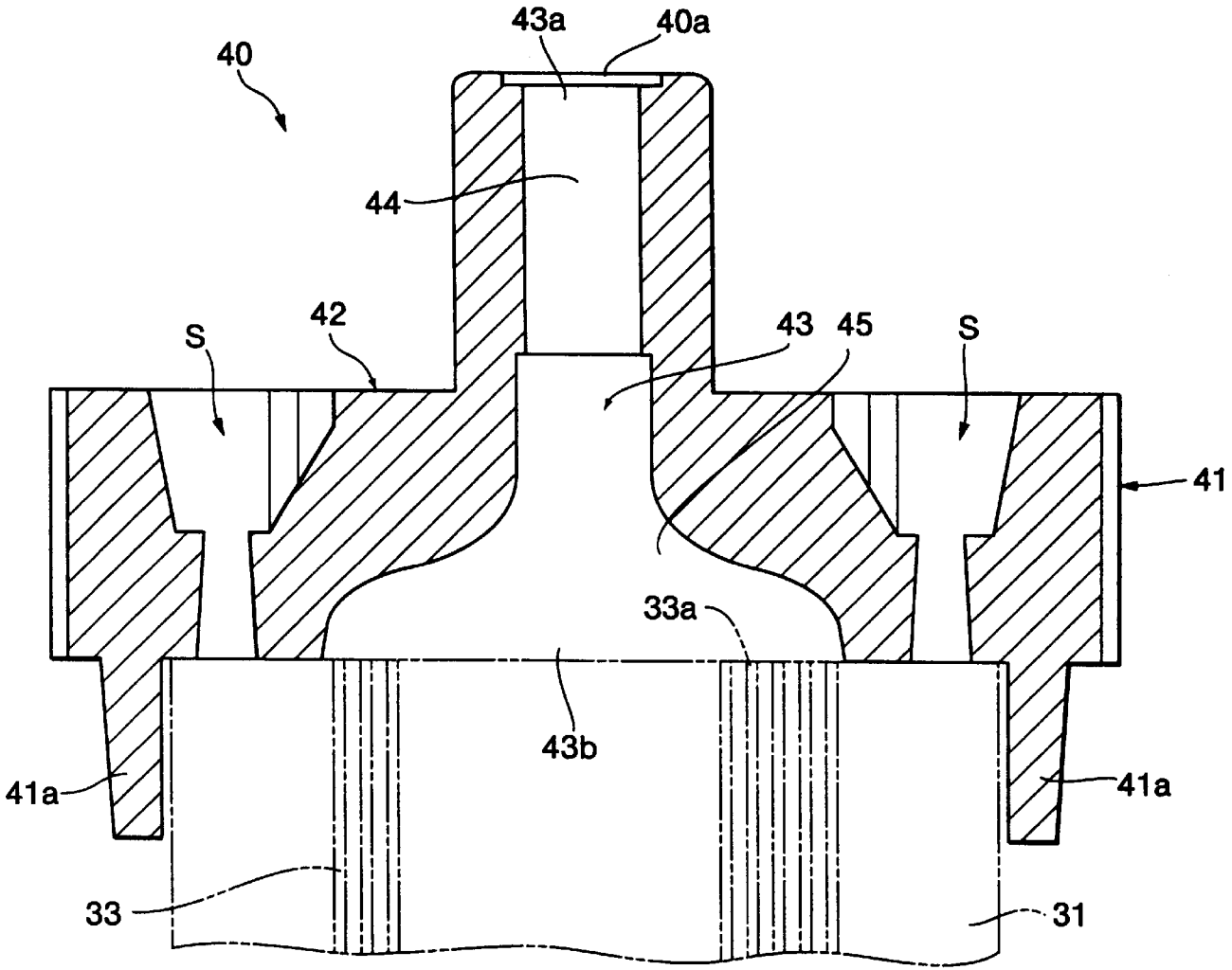
FIG. 5 is a cross-sectional view of the manifold and the ink jet head taken along a line V—V of FIG. 4.
Figure 6:
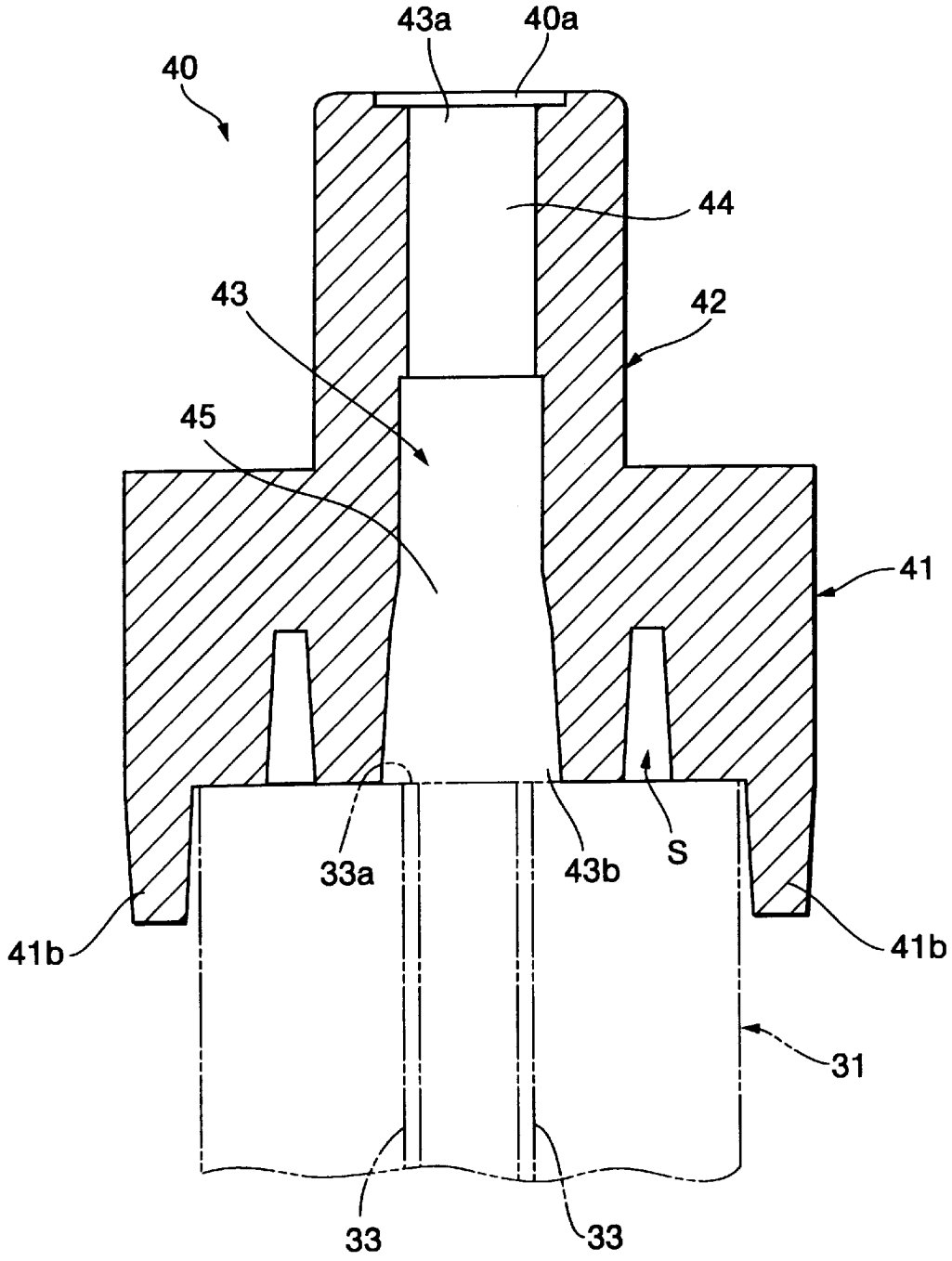
FIG. 6 is a cross-sectional view of the manifold and the ink jet head taken along a line VI—VI of FIG. 4.

As shown in FIGS. 5 and 6, the connection path 44 is substantially centered between the rows of ejection channels 33. The broad portion 45 broadens from the connection path 44 toward the ends of the rows of ejection channels 33 in an enlarging tapering manner, and has an ink outlet 43*b* encompassing the ink inlet ports 33*a* of the ejection channels 33. The broad portion 45 has a substantially symmetrical configuration with respect to a central axis, extending in the vertical direction, of the connection path 44.

As shown in FIG. 2, a space A is defined between the mesh filter 53*a* and the mesh filter 40*a*. The size and shape of the broad portion 45 is designed so that the volume of the space A is the same or larger than the volume of an imaginary spherical shape B, which is inscribed, in the geometric sense, by a ceiling surface of the broad portion 45 and the upper surface 31*a* of the ink jet head 31 and which closes up the connection path 44.

As shown in FIG. 1, the ink jet recording device 1 further includes an ink suction unit 21, a wiper unit 26, a protection cap unit 27, and an ink support member 28. The ink suction unit 21, the wiper unit 26, and the protection cap unit 27 are disposed in a reset position of the ink jet heads 31, that is, at a position at the side of the platen roller 18. The ink suction unit 21 is for performing purging operations. The wiper unit 26 is for wiping the nozzle plates 34 of the ink jet heads 31. The protection cap unit 27 is for covering the nozzle plate 34 when printing is not being performed so that ink in the nozzles will not dry out. The ink support member 28 is disposed in a forced ejection position which is at the opposite end of the platen roller 18 from the reset position. The ink support member 28 is for absorbing and maintaining ink that was forcibly ejected from the ink jet heads 31. The forcible ink ejection is performed periodically for preventing the nozzles of the nozzle plate 34 from clogging. The ink suction unit 21, the wiper unit 26, the protection cap unit 27, and the ink support member 28 together configure a recovery maintenance mechanism for recovering and maintaining good ejection condition of the ink jet heads 31.

The ink suction unit 21 includes a suction pump 22, a suction portion 23, a waste ink tank 24, and a cam 25. The suction pump 22 and the suction portion 23 are driven by the drive force transmitted from a drive force transmission mechanism (not shown) and the cam 25. The ink suction unit 21 performs the purging operations regularly or when needed during the printing operations, and also right after the ink cartridge 50 is exchanged so as to introduce fresh ink from a new ink cartridge 50 into the ink supply path 43 and the ejection channels 33.

During the purging operations, the suction portion 23 covers the nozzle plate 34 of the ink jet head 31. In this condition, the suction pump 22 generates a negative purging pressure in the suction portion 23, so that defective ink with air bubbles is sucked out from the ejection channels 33 and the ink supply path 43. As a result, fresh ink is introduced from the ink cartridge 50 into the ink supply path 43 and the ejection channels 33. In this way, the ink jet head 31 becomes ready for printing. The defective ink sucked form the ink jet head 31 in this manner is conveyed to and held in the waste ink tank 24.

Next, detailed description of the purging operations performed directly after exchange of the ink cartridge 50 will be provided. When the ink cartridge 50 is replaced, ink is supported in the new ink cartridge 50 by surface tension at the mesh filter 53*a,* but no ink exists in areas external from the mesh filter 53*a*. Accordingly, when the new ink cartridge 50 is mounted on the small diameter connection path 44 of the manifold 40, air fills the space A although some ink can remain in the ink supply path 43. In this condition, the ink suction unit 21 is driven to generate a negative purging pressure in the ink supply path 43. As a result, the air bubble is sucked from the space A into the broad portion 45. At this time, because the volume of the space A is set to the same or larger than the volume of the spherical shape B, the air bubble forms substantially the spherical shape B, which, as mentioned previously, is inscribed by the ceiling surface of the broad portion 45 and the upper surface 31*a* of the ink jet head 31 and which closes off the connection path 44. Therefore, the purging pressure will effectively operate both on the air bubble and ink in the broad portion 45 without the ink flowing around the air bubble. Therefore, the air bubble can reliably pulled into the ejection channels 33 and discharged out of the ink jet head 31 into the ink suction unit 21.

It should be noted that when ink in the ink supply path 43 has been consumed, that is, so that air exists on both sides of the mesh filter 40*a,* then, the volume of air that must be discharged by the purging operations after replacement of the ink cartridge 50 is greater than the volume of the space A. Therefore, the air bubble in the broad portion 45 may not have the substantially spherical shape B. However, regardless of the shape of the air bubble, the air bubble will be inscribed by the ceiling surface of the broad portion 45 and the upper surface 31*a* of the ink jet head 31, and will close up the connection path 44. Therefore, the air bubble will be reliably discharged by the purging operations.

Also, because the manifold 40 is mounted on the ink jet head 31 so as to cover the ink inlet port 33*a* of the ejection channels 33 from the above, the air bubble introduced into the broad portion 45 attempts to float upward, so that the connection path 44 will be reliably covered up by the air bubble.

As described above, according to the present invention, when air that has been introduced into the ink supply path 43 during exchange of the ink cartridge 50 forms a substantially spherical air bubble in the broad portion 45, the air bubble blocks off the connection path 44. Therefore, the negative purging pressure generated during the purging operations will operate effectively on the air bubble. As a result, the air bubble can be easily drawn into the ink chambers 33, so that the ability of the ink jet recording device 1 to discharge the air bubble during the purging operations is increased.

While the invention has been described in detail with reference to specific embodiments thereof, it would be apparent to those skilled in the art that various changes and modifications may be made therein without departing from the spirit of the invention, the scope of which is defined by the attached claims.

For example, in the above described embodiment, the size and shape of the broad portion 45 are designed so that the air bubble forms the substantial spherical shape B, and so is inscribed by the upper surface 31*a* of the ink jet head 31 and blocks off the small diameter connection path 44. However, the air bubble need not have the substantially spherical shape B as long as the air bubble is maintained in contact with the upper surface 31*a* of the ink jet head 31.

Also, the air bubble needs not block off the connection path 44. However, it is desirable that the broad portion 45 be designed with size and shape that induces the air bubble to block off the connection path 44 for the reasons described above.

Also, in the above described embodiment, the mesh filter 53*a* is provided to the ink supply port 53 of the ink cartridge 50 for preventing ink from leaking from the ink cartridge 50 when the cartridge 50 is being exchanged. However, in the case when the ink absorption member 54 is provided adjacent to the inner surface of the ink supply port 53, the mesh filter 53*a* can be dispensed with. In this case, a space defined between the ink absorption member 54 and the mesh filter 40*a* is considered as the space A.

Further, in the above-described embodiment, purging operations are performed by the ink suction unit 21 by sucking ink from the ejection channels 33 of the ink jet head 31. However, purging operations can be performed by pushing fresh ink from the ink cartridge 50 into the ink jet head 31.

What is claimed is:

1. An ink jet recording device comprising:

an ink jet head that has a first surface and a second surface opposite from the first surface, the ink jet head being formed with a plurality of ink channels each extending from the first surface to the second surface, each ink channel having an inlet port opened at the first surface and a nozzle opened at the second surface;

a manifold that is mounted on the first surface of the ink jet head, the manifold being formed with an ink inlet path and an ink supply path fluidly connecting the ink inlet path with the plurality of the ink channels; and a cartridge that is replaceable and detachably mounted on the manifold and stores ink, the cartridge being formed with an outlet port for supplying ink to the plurality of ink channels through the outlet port, the ink inlet path, the ink supply path, and the inlet port, wherein when the cartridge is replaced, and air is introduced as a single air bubble into the ink supply path from the ink inlet path, the single air bubble is supported within the ink supply path while contacting the first surface of the ink jet head, wherein the manifold has a manifold filter provided to the ink inlet path, and the cartridge has a cartridge filter provided to the outlet port, and wherein the manifold filter and the cartridge filter define a space therebetween, the space allowing the air to be introduced thereinto during replacing the cartridge and the ink supply path is defined by an inner surface, the space defined between the manifold filter and the cartridge filter has a predetermined volume that is the same or larger than the volume of a substantially spherical space which is described by the inner surface of the ink supply path and the first surface of the ink jet head.

2. The ink jet recording device according to claim 1, wherein the ink supply path broadens from an ink inlet path side in a tapering manner to encompass the inlet ports of the plurality of ink channels, the ink supply path is defined by an inner surface, and wherein the single air bubble supported in the ink supply path is inscribed by the inner surface and blocks off the ink inlet path.

3. The ink jet recording device according to claim 1, further comprising a purging unit that is detachably attached to the second surface of the ink jet head, the purging unit generating a negative pressure in the ink supply path to introduce the ink into the plurality of ink channels from the cartridge through the ink supply path.

4. The ink jet recording device according to claim 3, wherein the air is introduced as the single air bubble into the ink supply path when the purging unit generates the negative pressure in the ink supply path.

5. The ink jet recording device according to claim 4, wherein the single air bubble in the ink supply path is drawn into the ink channels and discharged out of the ink jet head through the nozzles when the purging unit generates the negative pressure.

6. The ink jet recording device according to claim 1, wherein the first surface of the ink jet head faces upward.

7. The ink jet recording device according to claim 1, wherein the plurality of ink channels are arranged in a row, and the ink inlet path is substantially centered with respect to the row.

8. The ink jet recording device according to claim 7, wherein the ink supply path has a symmetrical configuration with respect to a central axis of the ink inlet path, the central axis extending in a direction in which the plurality of ink channels extend.

* * * * *